US005971189A

United States Patent [19]

Baughman

[11] Patent Number: 5,971,189

[45] Date of Patent: Oct. 26, 1999

[54] PLASTIC DRUM CLOSURE

[75] Inventor: Gary M. Baughman, Auburn, Ind.

[73] Assignee: Rieke Corporation, Auburn, Ind.

[21] Appl. No.: 08/880,589

[22] Filed: Jun. 23, 1997

Related U.S. Application Data

[63] Continuation of application No. 08/153,601, Nov. 16, 1993, Pat. No. 5,680,953.

[51] Int. Cl.[6] ..... B65D 25/00

[52] U.S. Cl. ..... 220/288; 220/304

[58] Field of Search ..... 220/288, 304, 220/4.04, 4.05, 254, 465

[56] References Cited

U.S. PATENT DOCUMENTS

| | | | |
|---|---|---|---|
| 1,324,896 | 12/1919 | Hettinger . | |
| 1,640,508 | 8/1927 | Lobl | 220/304 X |
| 2,008,245 | 7/1935 | Curtis et al. . | |
| 2,025,852 | 12/1935 | Dillhoefer, Jr. . | |
| 2,291,706 | 8/1942 | Frease | 220/304 X |
| 2,339,255 | 1/1944 | Dodson . | |
| 2,445,805 | 7/1948 | Robinson . | |
| 2,769,566 | 11/1956 | Thompson . | |
| 2,906,429 | 9/1959 | Marchyn . | |
| 3,027,042 | 3/1962 | Graves . | |
| 3,122,262 | 2/1964 | Hagmann et al. . | |
| 3,173,569 | 3/1965 | Craig | 220/304 |
| 3,346,278 | 10/1967 | Yocum . | |
| 3,380,618 | 4/1968 | Phillips . | |
| 3,405,837 | 10/1968 | Carpenter, Jr. . | |
| 3,487,442 | 12/1969 | Rossmann . | |
| 3,589,550 | 6/1971 | Rossmann . | |
| 3,664,540 | 5/1972 | Witkin . | |
| 3,891,118 | 6/1975 | Laurizio . | |
| 4,005,799 | 2/1977 | Mannaerts . | |
| 4,078,696 | 3/1978 | Crisci . | |
| 4,146,207 | 3/1979 | Rofe | 220/304 X |
| 4,164,304 | 8/1979 | Roberson | 220/288 X |
| 4,190,171 | 2/1980 | Kulle et al. . | |
| 4,201,306 | 5/1980 | Dubois et al. | 220/4.05 |
| 4,245,753 | 1/1981 | Ellis | 220/304 X |
| 4,785,963 | 11/1988 | Magley . | |
| 4,850,194 | 7/1989 | Grosser . | |
| 5,207,345 | 5/1993 | Stewart et al. | 220/304 X |
| 5,211,304 | 5/1993 | Stolzman . | |
| 5,680,953 | 10/1997 | Baughman | 220/288 |

FOREIGN PATENT DOCUMENTS

| | | |
|---|---|---|
| 1003541 | 3/1952 | France . |
| 51-113755 | of 1976 | Japan . |
| 1-55315 | of 1989 | Japan . |
| 5-38411 | of 1993 | Japan . |
| 352256 | 2/1961 | Switzerland . |
| 2 227 736 | 8/1990 | United Kingdom . |

*Primary Examiner*—Steven Pollard
*Attorney, Agent, or Firm*—Woodard, Emhardt, Naugton Moriarty & McNett

[57] ABSTRACT

A closure assembly for a shipping and storage drum where the drum includes an internally threaded plastic outlet for receipt of the closure assembly includes a plastic closure having a generally cylindrical main body portion which is externally threaded and which constitutes the leading edge of threaded engagement into the outlet. Disposed at the upper end of the main body portion and integral therewith is an annular, peripheral flange the underside of which is shaped with an annular groove which is designed to receive an elastomeric gasket. The annular groove has an outwardly inclined outer wall and a generally cylindrical inner wall. The gasket is held in position as part of the closure by an interference fit between the inside surface of the gasket and the inner cylindrical wall of the groove. The plastic outlet of the shipping and storage drum includes a generally cylindrical raised rib and outward thereto and concentric therewith a generally cylindrical raised wall. Upon full threaded engagement of the closure into the outlet, the raised rib presses into the central area of the elastomeric gasket and the upper surface of the closure is seated within the raised wall and is below the top surface of the wall. The external threads of the closure arranged with two threaded portions, one portion being a straight thread and the lower or leading edge portion being a tapered thread. The thread pitch is the same and the threads are continuous with each other.

15 Claims, 4 Drawing Sheets

PLASTIC DRUM CLOSURE

This application is a continuation of application Ser. No. 08/153,601, filed Nov. 16, 1993, now U.S. Pat. No. 5,680, 953.

BACKGROUND OF THE INVENTION

The present invention relates in general to externally threaded plastic closures for plastic drums of the type where the opening(s) in the drum have standard two inch (5.08 cm) NPS threads. More particularly, the present invention relates to plastic closures which have a gasket encapsulating structure in the closure flange and external threads arranged with a straight portion and a lower tapered portion.

Drum manufacturers and plastic drum reconditioners have the majority of their processing problems either manufacturing or servicing the two inch (5.08 cm) NPS threaded opening. Because of the inherent design of the NPS thread (originally designed for steel pipe fittings), drum manufacturers have a very difficult time manufacturing a drum which will perform to the required Department of Transportation and United Nations regulations. Typically the first area to fail is the two inch (5.08 cm) NPS threaded opening. Reconditioners have significant problems with the NPS opening ovalizing and shrinking to the point where a plastic drum closure cannot be screwed into the opening in the drum end. However, drum users want to maintain the NPS thread due to adaptability of existing pumps and faucets.

The present invention provides an improvement and solution to the foregoing problem by a unique thread configuration and gasket encapsulating structure. The present invention addresses the problems of ovalization and shrinkage at the reconditioners and performance problems at the drum manufacturers. In the present invention the external threads on the closure are configured with one portion which is straight, exhibiting a constant pitch diameter, while the bottom most portion (bottom three threads) is tapered, or has a reducing pitch diameter. The pitch of both the straight and tapered threads is constant and this feature allows the closure to be installed in drum openings which have ovalized or shrunk, problems which are typically experienced by drum reconditioners. This opening or outlet distortion is caused by the temperature of cleaning solutions involved in the reconditioning process. Distortion is promoted due to the relaxation of material stresses which are introduced in the original manufacturing process of the plastic drum and its opening.

The gasket encapsulating feature of the present invention improves the performance of a plastic drum with respect to maintaining a seal when pressurized. When a plastic drum is pressurized there is noticeable distortion and it may radically change shape. Typically this distortion causes the drum closures to leak because there is not constant pressure exerted on all areas of the sealing gasket. The present invention is designed to flex in cooperation with the distortion of the opening and the gasket encapsulating means disclosed by the present invention keeps the relative softer gasketing material in proper placement so as to effect a liquid-tight seal. Without the gasket encapsulating arrangement as part of the closure flange, a gasket would tend to deform outwardly when the container is exposed to higher internal pressures. Attempts to restrict this gasket movement using only the configuration of the drum outlet has proven to be ineffective. However, putting the gasket encapsulating feature of the present invention on the closure flange has solved the problem of gasket movement.

There is one additional benefit to the design of the present invention which is a result of the required manufacturing method. Due to the relationship of the undercut groove in the flange (gasket encapsulated feature) and the threads, the plastic closure of the present invention must be unscrewed from a mold cavity. Typically, external threads are molded using some arrangement of collets or half moon split blocks which are closed in the molding position and opened in the ejection process. With normal tooling wear this causes flash at the interfaces of the collet jaws or split block mating surfaces. Flash which is formed is likely to break off from the closure when the closure is applied to the drum outlet. Any flash which does break off will likely land in the drum, contaminating the contents of the drum with minute plastic particles. Since the threads on the present invention are unscrewed from the mold cavity, there are no mating tool surfaces to wear in a manner that permits flash and thus there is no flash in the threaded area nor in the container.

Over the years a number of closure designs have been invented to address specific problems and concerns. In many of these earlier designs some type of seal member is provided in order to assist in sealing the interface between the container outlet and the closure. In some of these earlier designs there are special threads or modified threads, again, intended to address or solve some specific problem. The following list of patent references is believed to be a representative sampling of these earlier closure and mating thread designs:

| Patent No. | Patentee | Issue Date |
|---|---|---|
| 4,190,171 | Kulle et al. | 2-26-80 |
| 2,008,245 | Curtis et al. | 7-16-35 |
| 2,906,429 | Marchyn | 9-29-59 |
| 3,346,278 | Yocum | 10-10-67 |
| 3,027,042 | Graves | 3-27-62 |
| 2,025,852 | Dillhoefer, Jr. | 12-31-35 |
| 3,664,540 | Witkin | 5-23-72 |
| 3,589,550 | Rossmann | 6-29-71 |
| 3,487,442 | Rossmann | 12-30-69 |
| 3,405,837 | Carpenter, Jr. | 10-15-68 |
| 3,380,618 | Phillips | 4-30-68 |
| 3,891,118 | Laurizio | 6-24-75 |
| 2,339,255 | Dodson | 1-18-44 |
| 2,445,802 | Robinson | 7-27-48 |
| 1,324,896 | Hettinger | 12-16-19 |
| 4,078,696 | Crisci | 3-14-78 |
| 3,122,262 | Hagmann et al. | 2-25-64 |
| 4,005,799 | Mannaerts | 2-1-77 |
| 5,211,304 | Stolzman | 5-18-93 |
| 4,146,207 | Rofe | 3-27-79 |
| 2,769,566 | Thompson | 11-6-56 |
| 2,291,706 | Frease | 8-4-42 |
| GB 2 227 736 A | UK-Christy | 8-8-90 |
| 352256 | Switzerland | 2-15-61 |

While the array of concepts and features represented by the foregoing listed patent references covers a wide variety of structures, the specific features and combination of features of the present invention are not anticipated. Further, in view of the focused and specific nature of the list of references and the inability to compatibly combine various features, the present invention is such that it would not be obvious to one of ordinary skill in the art in view of the listed patent references.

SUMMARY OF THE INVENTION

A closure assembly for a shipping and storage drum wherein the drum has an internally threaded plastic outlet for receipt of the closure assembly, according to one embodiment of the present invention, comprises an integral plastic closure having an upper or top end and opposite thereto a bottom or lower end and including an externally threaded, main body portion and an outwardly radiating annular flange which is disposed at one end of the main body portion adjacent the upper end, the flange being formed with and defining a three sided annular groove opening down towards said bottom or lower end, the annular groove including a top wall, an outer inclined sidewall and an inner, generally cylindrical sidewall and an annular ring-shaped elastomeric gasket assembled into the groove and held in position by an interference fit with the generally cylindrical sidewall of the annular groove, the externally threaded main body portion being arranged with two threaded portions, an upper straight threaded portion and an lower tapered thread portion where the two threaded portions have the same pitch and are continuous with each other.

One object of the present invention is to provide an improved closure assembly for a plastic drum.

Related objects and advantages of the present invention will be apparent from the following description.

DESCRIPTION OF THE PREFERRED EMBODIMENT

Figure 1:
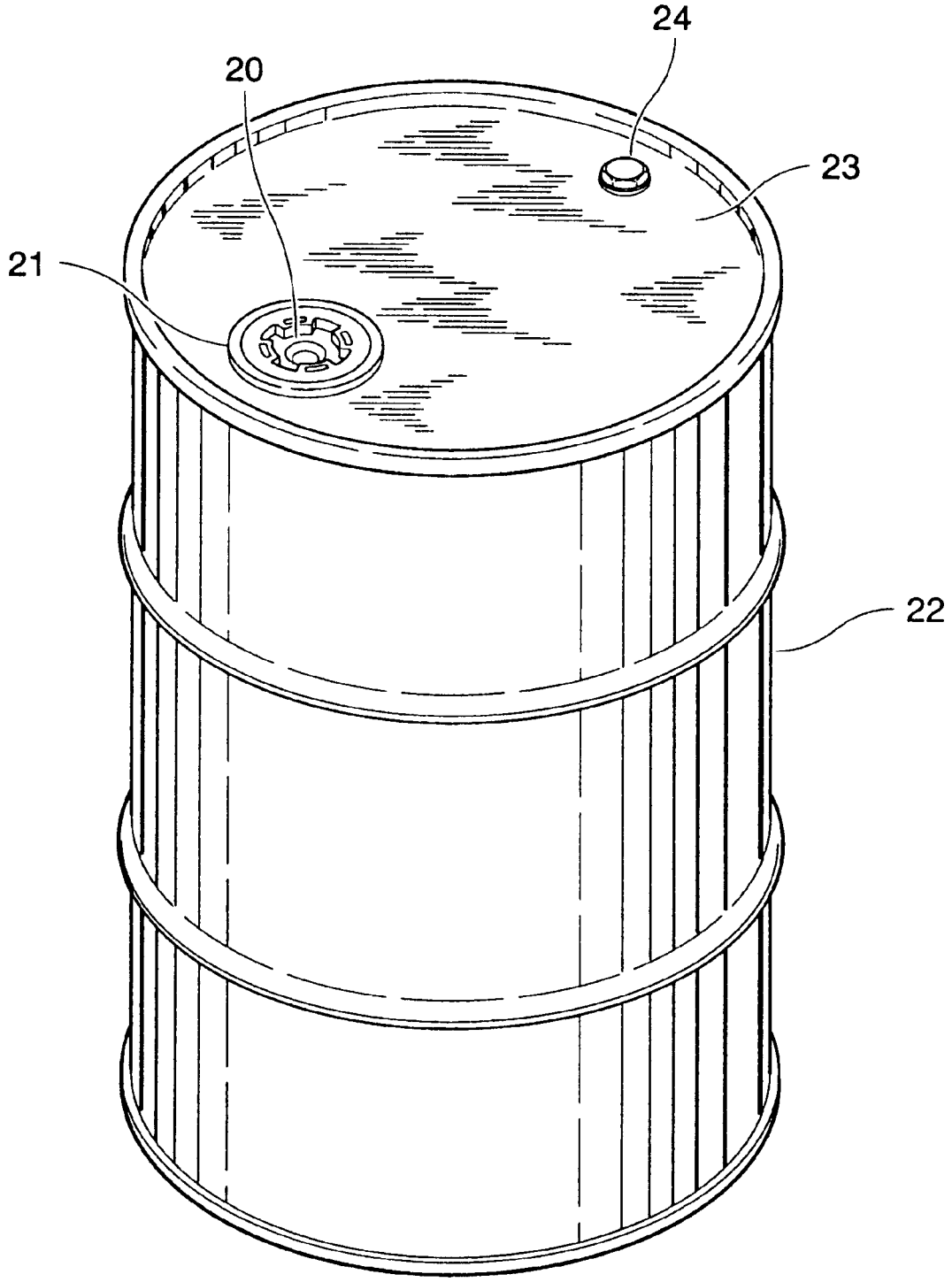
FIG. 1 is a perspective view of a plastic drum and closure assembly according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated a plastic closure which is threaded into and received by an internally threaded outlet 21 of plastic drum 22. While the plastic closure 20 of the present invention may be used on a variety of containers, the drum 22 of the FIG. 1 illustration is a plastic drum of the 55-gallon size and outlet 21 is molded integrally as part of container end (lid) 23. When the lid is designed to be removable it may be removed for filling of the drum. When the lid is integral with the drum, the opening of vent closure 24 provides an air escape and permits the easy filling of drum 22. Outlet 21 is a discharge outlet which is internally threaded with standard two inch (5.08 cm) NPS threads. One of the benefits of the NPS thread is the adaptability of existing pumps and faucets which is the desire of drum users. As a portion of the content of the drum are discharged from outlet 21 the vent closure 24 may be opened to facilitate the dispensing process. Closure 20 is designed to prevent the contents from spilling, leaking or otherwise escaping through outlet 21 during storage and/or transportation of drum 22.

Figure 2:
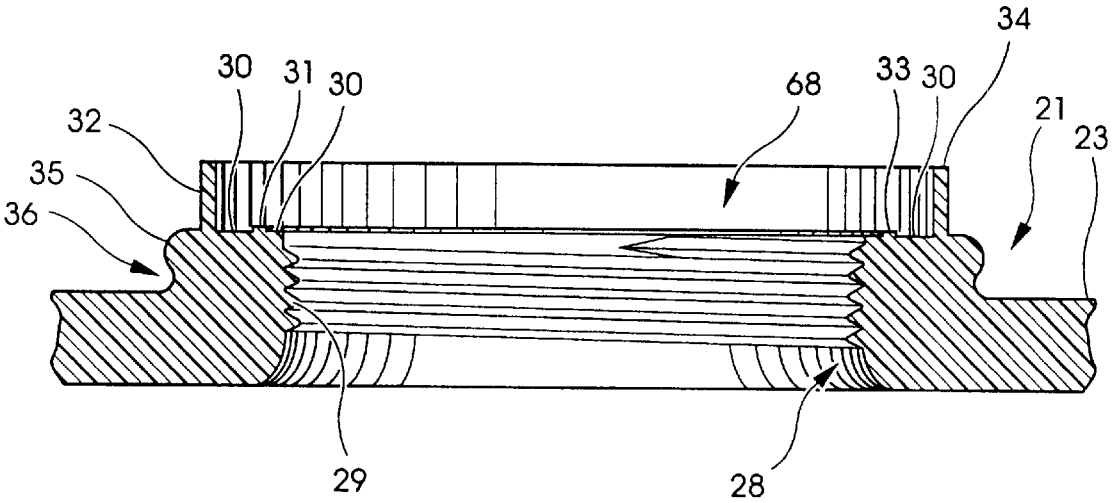
FIG. 2 is a partial, front elevational view in full section of the drum end of the FIG. 1 drum including an internally threaded raised outlet.

Referring to FIG. 2 the construction of outlet 21 is illustrated in greater detail. As noted, only a portion of drum lid 23 is illustrated, though it is clear that outlet 21 is an integrally molded portion of the drum lid. Outlet 21 includes a generally cylindrical, raised wall portion 28 which is internally threaded with standard two inch NPS threads 29. The threaded portion includes all of wall portion 28 and approximately one-half of the wall thickness of drum lid 23. The upper surface 30 of wall portion 28 is substantially flat and includes a relatively short raised axial rib 31 and a higher axial wall 32. The cross section of rib 31 is generally rectangular as illustrated in FIG. 2 with a substantially flat top surface 33. The cross section of wall 32 is generally rectangular as illustrated in FIG. 2 with a substantially flat top surface 34. Rib 31 and wall 32 are each generally cylindrical and are each generally concentric to each other and extend upwardly in a direction substantially normal to upper surface 30. Raised wall portion 28 includes an outer, annular radius peripheral edge 35 and an annular recessed area 36 beneath edge 35.

Figure 3:
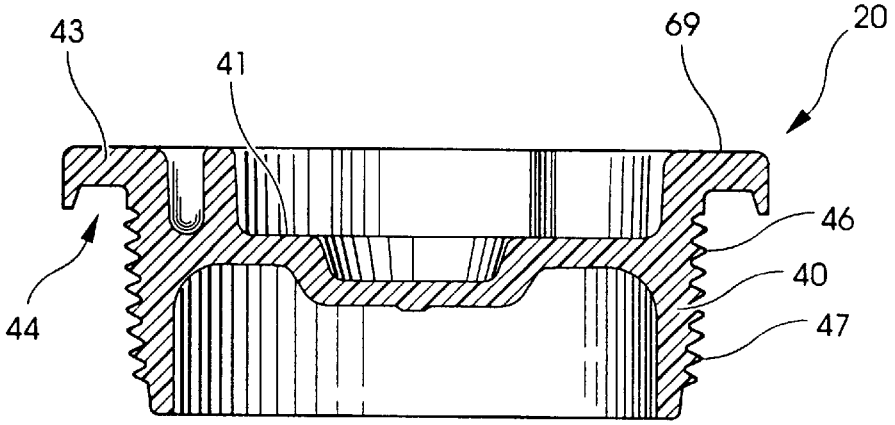
FIG. 3 is a front elevational view in full section of a closure which corresponds to the closure of FIG. 1 wherein the cutting plane for FIG. 3 is taken in the direction of the arrows as illustrated in FIG. 5.
Figure 4:
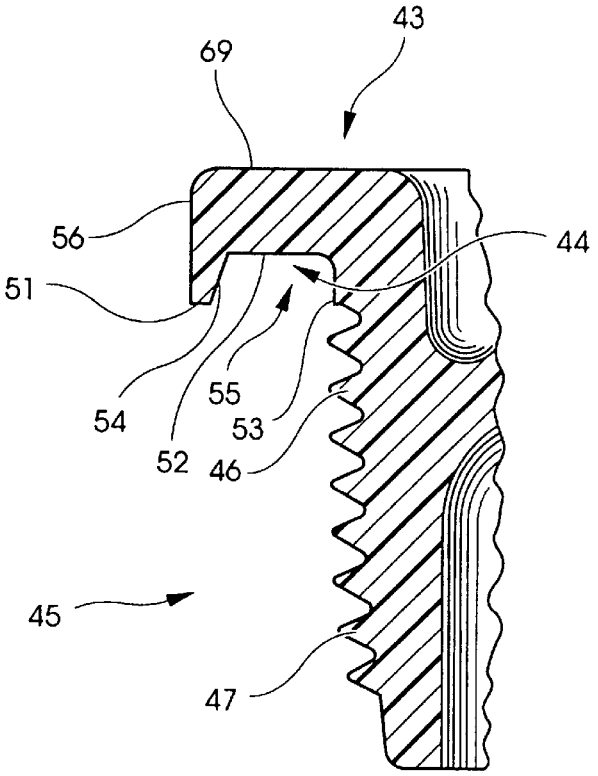
FIG. 4 is an enlarged, partial detail of the externally threaded main body portion of the FIG. 3 closure detailing one threaded portion with straight threads and a second threaded portion with tapered threads.
Figure 5:
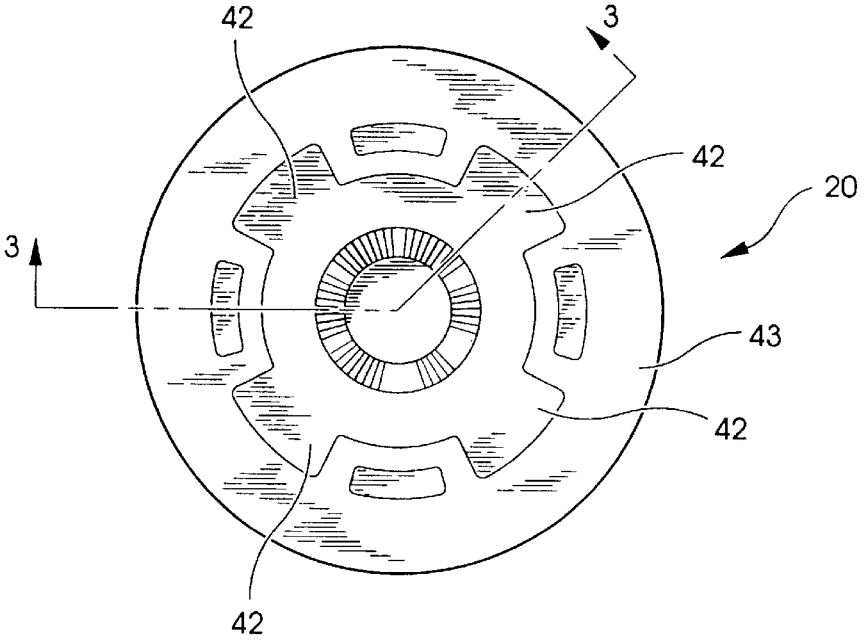
FIG. 5 is a top plane view of the FIG. 3 closure according to the present invention wherein the cross sectional view of FIG. 3 is taken in the direction of cutting plane 3—3.

Referring to FIGS. 3, 4 and 5 the nature and construction of closure 20 is illustrated in greater detail. Closure 20 includes a generally cylindrical main body 40, top surface 41, wrench engagement slots 42, annular peripheral flange 43 and annular groove 44. FIG. 4 is an enlarged detail of the external threads 45 of main body 40 which are arranged with a straight portion 46 and a tapered portion 47. FIG. 5 is a top plan view of closure 20 and the cutting plane depicted by line 3—3 in the direction of the arrows creates the cutting plane for the section view of FIG. 3. As illustrated, there are a total of four equally spaced wrench engagement slots 42 which are used to facilitate the threaded engagement of closure 20 into outlet 21 and the tightened securement, as well as the loosening and removal of closure from outlet 21.

The contouring of top surface 41 creates the four slots 42 and provides a strong and rigid surface which helps to maintain the desired, generally cylindrical shape of closure 20. Peripheral flange 43 is shaped as an annular ring which is integrally molded as an extension of main body 40 and is concentric with the main body. Formed in the lower surface 51 of flange 43 is annular groove 44. Groove 44 has an upper radially-extending, substantially flat wall 52, an inner, generally cylindrical, axially-extending wall 53 and an outer, inclined wall 54 which extends outwardly as it extends downwardly from wall 52. The resulting geometry of groove 44 is such that the open end 55 of groove 44 constitutes the widest point of the groove. The straight portion 46 of threads is positioned relative to groove 44 such that the outermost tip of the threads of portion 46 are in axial alignment with wall 53. Groove 44 is generally concentric with peripheral flange 43. Disposed as part of outer wall 56 of peripheral flange 43 is surface texturing, specifically knurling, which facilitates the secure gripping of closure 20 as its threaded engagement is initiated.

Figure 6:
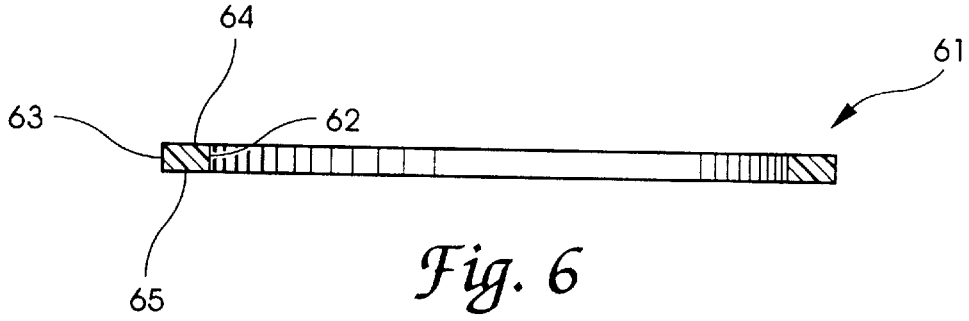
FIG. 6 is a side elevational view in full section of an elastomeric gasket providing a sealed interface between the FIG. 2 outlet and the FIG. 3 closure according to the present invention.

Referring to FIG. 6, elastomeric gasket 61 which is received within groove 44 is illustrated. Gasket 61 has annular ring shape with an inside cylindrical surface 62 and a generally concentric outer cylindrical surface 63. The top and bottom surfaces 64 and 65, respectively, are substantially flat and generally parallel to each other resulting in the gasket having a generally rectangular cross section.

Figure 7:
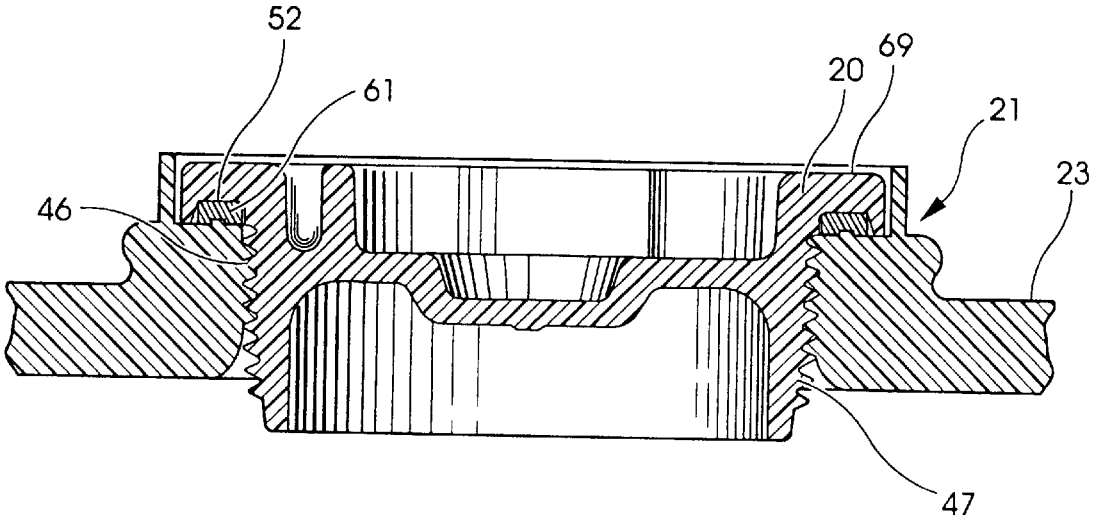
FIG. 7 is a front elevational view in full section of the FIG. 3 closure and FIG. 6 gasket as assembled onto the FIG. 2 outlet according to the present invention.

In the illustrated assembly of FIG. 7, the gasket 61 is positioned up into groove 44 such that top surface 64 is in abutment up against upper wall 52. The inside surface 62 is sized just slightly smaller than inner wall 53 so that the gasket must be stretched in order to fit over wall 53 as the gasket is assembled into groove 44. The slight interference fit causes the elastomeric gasket material to stretch uniformly around wall 52 and thereby hold the gasket onto the closure (and into groove 44). The gasket thus stays with the closure regardless of whether the closure 20 is threadedly engaged into the threaded outlet 21 or is removed from the outlet. A suitable gasket material for gasket 61 is ethylene propylene diene monomer (EPDM).

Referring to FIG. 7, the threaded assembly of the closure 20, with gasket 61 attached, into outlet 21 is illustrated. While the assembled relationships are all illustrated, a few aspects warrant specific mention. Closure 20 is able to initiate its threaded engagement into outlet 21, even if the outlet is slightly ovalized or has experienced slight shrinkage. This is due to the fact that the tapered nature of thread portion 47 creates a smaller outside diameter for the lower end of the main body of the closure and it is thus easier to insert this lower end into the outlet. Since the lower end of closure 20 is small enough to allow the first thread to fit down into the threaded interior 68 of outlet 21 it is possible to then initiate thread engagement with threads 29. As the closure 20 is advanced it forces the outlet into some slight reshaping so as to allow the outlet to conform to the closure. There would no doubt be some minor reshaping of the closure in order to balance whatever interference forces may be present between the outlet and the closure, depending on the degree of shrinkage and any ovalizing of the outlet 21.

As the closure 20 moves axially down into outlet 21, gasket 61 is drawn into abutment against the top surface of axial rib 31. With further advancement of the closure into the outlet, gasket 61 abuts up against upper surface 30 and the axial rib 31 pushes up into the center area of gasket 61. The FIG. 7 illustration is consistent with the section view of FIG. 3 based upon the cutting plane of FIG. 5. The engagement of axial rib 31 up into gasket 61 is generally the same throughout the entire gasket due to the annular ring design of gasket 61 and the annular, generally cylindrical shape of axial rib 31.

When closure 20 is tightly sealed into and onto outlet 21, the top surface 69 of flange 43, which coincides with the top surface of the wall portions defining the four wrench engagement slots, is positioned slightly below the top surface 34 of axial wall 32. The sealed interfaces which are created between the closure and the outlet include first the mating threads which provide a primary form of sealing between two members and from there there is a next sealing location across gasket 61. The use of axial rib 31 provides not only a larger surface area for sealing but it also serves as a type of stress concentration point which axially increases or enhances the sealing force of gasket 61 between the closure 20 and outlet 21.

As the upper surface 30 and axial rib 31 push upwardly against elastomeric gasket 61, the gasket would normally move in all directions. However, since the gasket is encapsulated between walls 53 and 54 on opposite sides and controlled on its top face by upper wall 52, gasket 61 is capable of only very limited movement. The angularity of inclined wall 54 relative to the straight outer surface 63 creates a slight as clearance, but the elastomeric gasket materials pushes into and consumes this clearance space very early in the gasket compression process. Thereafter, continued threaded advancement of closure 20 into outlet 21 causes the degree of sealing engagement in an axial direction to be increased over what would be possible if the sides of the gasket 61 were not encapsulated between walls 53 and 54.

One application for the present invention is for use in combination with a plastic drum when the drum is pressurized. Under pressure a plastic drum will typically experience a change in shape and quite often this shape distortion causes the drum closures to leak. Leakage of this type is caused primarily because there is not constant pressure exerted on all areas of the sealing gasket. The present invention is designed to flex in cooperation with any distortion of the opening. The gasket encapsulating arrangement of walls 53 and 54, as well as wall 52 to some extent, helps to keep the relatively softer gasket material in a proper location so as to effect a seal, even when the interior of the drum is pressurized and some distortion occurs. Without the outer wall for gasket 61 there would be no means to control or limit the outward deformation of the gasket when the interior of the drum is exposed to higher internal pressures.

Another aspect of the present invention, the elimination of flash, which has been briefly mentioned in the Background is to some extent dictated by the arrangement of groove 44. Due to the relationship of groove 44 and the threads of closure 20, closure 20 must be unscrewed from its mold cavity. As a consequence, there are no mating tool surfaces which can with time wear to a point that flash occurs at the interfaces of the collet jaws or split block mating surfaces. Since closure 20 will not have any flash present in its threaded portions, there is no risk that this flash can break off into the interior of the drum and contaminate the drum contents with minute plastic particles.

With further reference back to the Background portion hereof, and with a view of the foregoing technical description, it should be clear that the various problems which drum manufacturers and plastic drum reconditioners have to deal with have been addressed by the present invention and those problems have been solved in a most convenient and efficient manner.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A closure assembly for a shipping and storage drum, said drum having an internally threaded plastic outlet for receipt of said closure assembly, said closure assembly comprising:

a plastic closure having an exterior end which remains outside of said internally threaded outlet and opposite thereto an inserted end which extends into said threaded outlet when said closure is received by the storage drum, said closure being formed as an integral one-piece member and including an externally threaded, generally cylindrical main body portion and an outwardly radiating annular flange adjacent said exterior end and being disposed at one end of said main body portion, said flange being formed with and defining a three-sided, annular groove opening towards said inserted end and including a top axial wall, an outer inclined sidewall and an inner, generally cylindrical sidewall; and an annular ring-shaped elastomeric gasket having an inside, generally cylindrical surface and being assembled into said groove and being held in position by sizing the generally cylindrical sidewall larger than said generally cylindrical surface thereby causing the gasket to stretch in order to fit around said generally cylindrical sidewall.

2. A closure assembly for a shipping and storage drum, said drum having an internally threaded plastic outlet for receipt of said closure assembly, said closure assembly comprising:

a plastic closure having an exterior end which remains outside of said internally threaded outlet and opposite thereto an inserted end which extends into said threaded outlet when said closure is received by the storage drum, said closure being formed as an integral one-piece member and including an externally threaded, generally cylindrical main body portion and an outwardly radiating annular flange adjacent said exterior end and being disposed at one end of said main body portion, said flange being formed with an annular groove opening toward said inserted end;

an annular ring-shaped elastomeric gasket assembled into said groove; and said externally threaded main body portion being arranged with two thread portions including a straight thread portion adjacent said exterior end and a tapered thread portion adjacent said inserted end, said two threaded portions having the same pitch and being continuous with each other.

3. The closure assembly of claim 2 wherein said plastic closure is formed with a plurality of wrench slots to assist in tightening and removing said closure from said plastic outlet.

4. The closure assembly of claim 2 wherein said annular groove is defined in part by an inner, generally cylindrical sidewall and wherein the outermost radial extent of said straight thread portion is in axial alignment with said generally cylindrical sidewall.

5. In combination:

a shipping and storage drum having a drum end and an internally threaded, plastic outlet disposed in said drum end, said plastic outlet including an inner, generally cylindrical raised rib and an outer, generally cylindrical raised wall;

a plastic closure formed as an integral member and including an externally threaded main body portion and an outwardly radiating flange, said flange being formed with and defining an annular groove opening towards said shipping and storage drum;

an elastomeric gasket assembled into said groove and held in position by an interference fit around said groove; and said externally threaded main body portion being arranged with two threaded portions including a straight thread portion and a tapered thread portion, said two threaded portions having the same pitch, said tapered thread portion being the first threads inserted into said internally threaded plastic outlet.

6. The combination of claim 5 wherein said raised rib is pressed into said gasket when said plastic closure and gasket are fully seated into said plastic outlet.

7. The combination of claim 6 wherein the uppermost portion of said plastic closure is disposed below the uppermost edge of said raised wall when said plastic closure is fully seated into said plastic outlet.

8. The combination of claim 7 wherein said gasket is pressed onto the top surface of said plastic outlet when the closure is fully seated within said plastic outlet.

9. The combination of claim 5 wherein the uppermost portion of said plastic closure is disposed below the uppermost edge of said raised wall when said plastic closure is fully seated-into said plastic outlet.

10. The combination of claim 5 wherein said annular groove is defined in part by an inner, generally cylindrical sidewall and wherein the outermost radial extent of said straight thread portion is in axial alignment with said generally cylindrical sidewall.

11. In combination:

a shipping and storage drum having a drum end and an internally threaded, plastic outlet disposed in said drum end, said plastic outlet including an inner, generally cylindrical raised rib and an outer, generally cylindrical raised wall;

a plastic closure having an exterior end which remains outside of said internally threaded outlet and opposite thereto an inserted end which extends into said threaded outlet when said closure is received by the storage drum, said closure being formed as an integral one-piece member and including an externally threaded, generally cylindrical main body portion and an-outwardly radiating annular flange adjacent said exterior end and being disposed at one end of said main body portion, said flange being formed with and defining a three-sided, annular groove opening towards said inserted end and including a top axial wall, an outer inclined sidewall and an inner, generally cylindrical sidewall; and an elastomeric gasket assembled into said groove and held in position by an interference fit around said groove.

12. The combination of claim 11 wherein said raised rib is pressed into said gasket when said plastic closure and gasket are fully seated into said plastic outlet.

13. The combination of claim 12 wherein the uppermost portion of said plastic closure is disposed below the uppermost edge of said raised wall when said plastic closure is fully seated into said plastic outlet.

14. The combination of claim 13 wherein said gasket is pressed onto the top surface of said plastic outlet when the closure is fully seated within said plastic outlet.

15. The combination of claim 11 wherein the uppermost portion of said plastic closure is disposed below the uppermost edge of said raised wall when said plastic closure is fully seated into said plastic outlet.

* * * * *